US011073795B2

(12) United States Patent
Vaucher

(10) Patent No.: US 11,073,795 B2
(45) Date of Patent: Jul. 27, 2021

(54) PALLETS FOR THE ESCAPEMENT OF A CLOCK MOVEMENT

(71) Applicant: Nivarox-FAR S.A., Le Locle (CH)

(72) Inventor: Frederic Vaucher, La Chaux-de-Fonds (CH)

(73) Assignee: Nivarox-FAR S.A., Le Locle (CH)

( * ) Notice: Subject to any disclaimer, the term of this patent is extended or adjusted under 35 U.S.C. 154(b) by 428 days.

(21) Appl. No.: 16/164,858

(22) Filed: Oct. 19, 2018

(65) Prior Publication Data

US 2019/0155219 A1 May 23, 2019

(30) Foreign Application Priority Data

Nov. 22, 2017 (EP) ..... 17203076

(51) Int. Cl.
*G04B 15/08* (2006.01)
*G04B 15/14* (2006.01)

(52) U.S. Cl.
CPC ..... *G04B 15/14* (2013.01); *G04B 15/08* (2013.01)

(58) Field of Classification Search
CPC ..... G04B 15/00; G04B 15/08; G04B 15/14
See application file for complete search history.

(56) References Cited

U.S. PATENT DOCUMENTS 2,864,232 A * 12/1958 Tuetey ..... G04B 15/14 368/132
3,335,562 A * 8/1967 Schneider ..... G04B 15/12 368/133
2012/0243386 A1* 9/2012 Semon ..... G04B 17/063 368/129
2013/0036599 A1* 2/2013 Queval ..... G04B 15/06 29/527.1
2015/0248112 A1* 9/2015 Stranczl ..... G04B 15/08 368/132

(Continued)

FOREIGN PATENT DOCUMENTS

CH 704 206 A2 6/2012
EP 2 320 280 A1 5/2011
EP 2 557 461 A1 2/2013

(Continued)

OTHER PUBLICATIONS

European Search Report dated May 22, 2018 in European Application 17203076.9 filed Nov. 22, 2017 (with English Translation of Categories of cited documents & Written Opinion).

*Primary Examiner* — Sean Kayes
(74) *Attorney, Agent, or Firm* — Oblon, McClelland, Maier & Neustadt, L.L.P.

(57) ABSTRACT

The invention relates to pallets for an escapement of a clock movement including a pallet-stone support, pallet-stones mounted on the pallet-stone support, a fork including first and second horns, a safety pin and a rod connecting the pallet-stone support to the fork and to the safety pin, the pallet-stone support, the rod, the safety pin and the fork forming a monolithic body of the pallets, the pallet-stone support, the rod and the safety pin being formed by a main layer of constant thickness, the first and second horns of the fork having a greater height than the constant thickness and being formed by the main layer, and also by an additional layer, the main layer and the additional layer forming the monolithic body of the pallets.

8 Claims, 1 Drawing Sheet

(56) References Cited

U.S. PATENT DOCUMENTS

| | | | | |
|---|---|---|---|---|
| 2015/0355598 | A1* | 12/2015 | Fussinger ..... | G04B 15/08<br>368/132 |
| 2017/0185041 | A1* | 6/2017 | Sarchi ..... | G04B 15/08 |

FOREIGN PATENT DOCUMENTS

| | | | |
|---|---|---|---|
| EP | 2 952 971 | A1 | 12/2015 |
| WO | WO 2014/146842 | A1 | 9/2014 |

* cited by examiner

PALLETS FOR THE ESCAPEMENT OF A CLOCK MOVEMENT

CROSS-REFERENCE TO RELATED APPLICATION

This application claims priority of European Patent Application No. 17203076.9 filed on Nov. 22, 2017 the entire disclosure of which is incorporated herein by reference.

TECHNICAL FIELD

The present invention relates to pallets for an escapement of a clock movement, in particular an escapement of the Swiss pallets type which has a monobloc body.

TECHNOLOGICAL BACKGROUND

By way of example, document EP2320280 discloses pallets for an escapement provided with a fork which is intended to cooperate with a pin mounted on a plate. In order to optimise the respective functions of the fork and the rod, the fork of the pallets is an attached piece, offset from the plane of the rod and of the safety pin. The fork is fixed to the rod by means of a stud driven into the respective openings machined into the fork and the rod, the stud also producing the spacing between the plane of the rod and of the fork. In conventional practice, the studs are metallic parts produced by profile-turning. A current problem with profile-turned studs is that they have cutting "dogs". In fact, when the chisel separates the part from the rod of material at the end of the cutting, the part is detached from the rod and leaves a very small piece of the material. This small cone of material termed "dog" is not desired because it does not form a reference face which is neat and perpendicular to the cylinder. These studs cannot be driven in "flush". Furthermore, assembly of these studs is difficult because they have a tendency to become deformed during assembly. The positioning precision of the fork relative to the pallet-stones or to the safety pin can have a negative effect on the performance of the escapement.

Another example is disclosed in EP2952971 which is directed to pallets for the escapement comprising a fork part, a support part for the pallet-stones, pallet-stones mounted on the support part for the pallet-stones and a rod. The rod makes it possible to connect the support part for the pallet-stones to the fork part. The fork part comprises a fork, a safety pin and a stud. The rod and the support part for the pallet-stones are integral and form a monolithic body for the pallets. The fork is an attached part fixed to the body by means of the stud driven into a fixing hole in the body and a fixing hole in the fork. The attached fork is at a spacing from the body. The stud has the particular feature of being manufactured from a material which does not substantially comprise any area which is plastic under stress.

Document CH704086 mainly relates to a method for manufacturing a metallic part, in particular pallets for an escapement mechanism which has three levels. The pallets are manufactured using a first mould engraved into a substrate in which a safety pin is placed, obtained by a LIGA process, which forms the first level of the pallets. The second and the third level of the pallets are produced with the help of two moulds formed by two superimposed photoresist layers. The pallets thus obtained comprise a monobloc rod, one end of which forms the two horns of the fork whilst a safety pin is fixed on a stud forming an integral part of the rod.

A main disadvantage of these pallets resides in the fact that the safety pin and the horns are two separate parts which involve imprecisions in the positioning of the safety pin relative to the horns when the fork or the safety pin is attached to the rod, in fact in the division heights of the safety pin and the horns. Furthermore, assembly of the rod of the pallets with the safety pin or the fork is a delicate operation.

Consequently the present invention aims to provide pallets for an escapement which are precise, reliable over a long period of use and easy to manufacture.

SUMMARY OF THE INVENTION

The invention relates to pallets for an escapement of a clock movement according to claim 1. The dependent claims describe advantageous aspects of the invention.

To this end, the pallets comprise a pallet-stone support, pallet-stones mounted on the pallet-stone support, a fork comprising first and second horns, a safety pin and a rod connecting the pallet-stone support to the fork and to the safety pin. The pallet-stone support, the rod, the fork and the safety pin form a monolithic body of the pallets. The pallet-stone support, the rod and the safety pin are formed by a main layer of constant thickness. The first and second horns of the fork have a greater height than the constant thickness and are formed by said main layer, and also by an additional layer. The main layer and the additional layer forming the monolithic body of the pallets.

According to an advantageous embodiment, the body of the pallets is produced by a lithographic and electroforming process.

According to an advantageous embodiment, the method is a method of the LIGA type with two levels. Advantageously the additional layer is formed before the main layer.

According to an advantageous embodiment, the ratio between the height of the first and second horns of the fork and the constant thickness of the main layer is between 1.5 and 10.

According to an advantageous embodiment, the first and second horns of the fork each comprise a bevelled surface which extends over the entirety of the height of said first and second horns.

According to an advantageous embodiment, the body of the pallets is manufactured from a material selected from the group of materials comprising silicon, silicon nitride, silicon carbide, steel, gold or one of its alloys, nickel, nickel-phosphorus, brass, copper-beryllium, nickel-silver, polymers, ceramic and amorphous metal.

The invention relates likewise to an escapement comprising pallets as described, and a clock movement comprising the escapement.

BRIEF DESCRIPTION OF THE FIGURES

The invention will be described hereafter in a more detailed manner with the help of the annexed drawings, given by way of example and non-limiting, in which.

DETAILED DESCRIPTION OF THE INVENTION

Figure 1A:
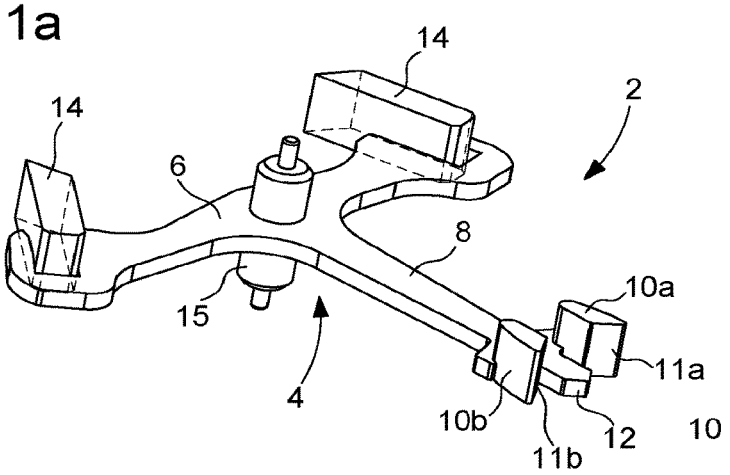
FIG. 1*a* is a perspective view from above of the pallets for an escapement mechanism of the Swiss pallets type, according to one embodiment of the invention.

With reference to the figures, pallets 2 for an escapement of the Swiss pallets type for a clock movement comprise a fork 10, a safety pin 12, a support part for the pallet-stones 6, pallet-stones 14 and a rod 8 interconnecting the support part for the pallet-stones 6 to the fork 10 and to the safety pin 12. The rod 8 is coupled in rotation to the plate of a clock movement by means of a pivot 15.

The pallet-stones 14 engage with the teeth of a pallet wheel (not illustrated) of the escapement which is connected to a power source providing a rotational torque on the wheel. One of the pallet-stones constitutes the input pallet-stone and the other constitutes the output pallet-stone, this being as a function of the alternation of rotation of the pallets 2.

The fork 10 comprises a first horn 10*a* and a second horn 10*b* provided on both sides of the safety pin 12. The fork engages with a plate pin of a double plate driven onto the axle of a balance wheel (not illustrated) which is intended to regulate the frequency of rotation of the pallet wheel by means of the pallets.

In one direction of rotation of the balance wheel, the first horn 10*a* acts as input horn and the second horn 10*b* as output horn. In the other direction of rotation, the functions of the first and second horns are reversed. The safety pin 12 makes it possible to avoid the pallets pivoting and thus the fork passing from the wrong side of the pin when an impact is produced.

The pallet-stone support 6, the rod 8, the safety pin 12 and the fork 10 formed by the first and second horns 10*a*, 10*b* form a monolithic body 4.

The pallet-stone support 6, the rod 8, the safety pin 12 are formed by a main layer of constant thickness E. The first and second horns 10*a*, 10*b* of the fork have a greater height H than the constant thickness E and are formed by said main layer and by an additional layer, the main layer and the additional layer forming the monolithic body 4 of the pallets 2.

The ratio between the height H of the first and second horns 10*a*, 10*b* and the thickness of the rod E of the body is, preferably, between 1.5 and 10.

The first and second horns 10*a*, 10*b* of the fork 10 each comprise a bevelled surface 11*a*, 11*b* extending over the entirety of the height H of the first and second horns and intended to cooperate with the plate pin of the balance wheel.

Figure 1B:
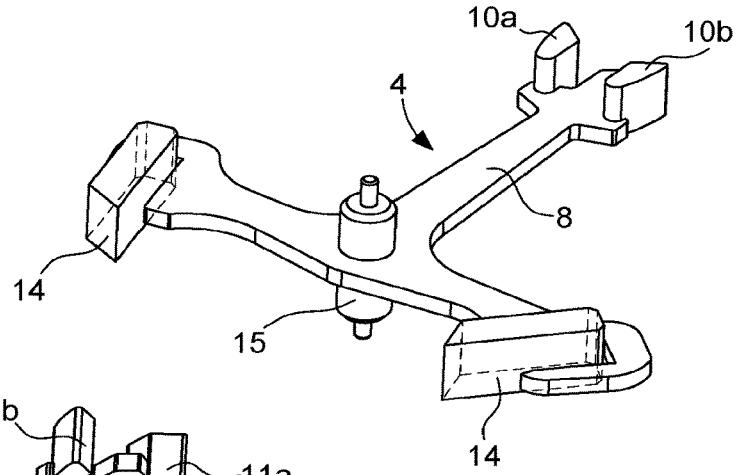
FIG. 1*b* is one similar to FIG. 1 a according to a different orientation.
Figure 1C:
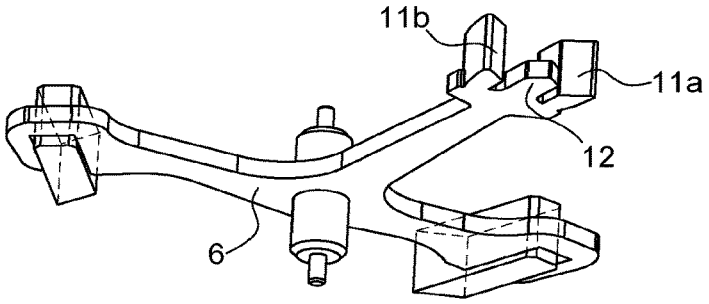
FIG. 1*c* is a perspective view from below of the pallets.
Figure 2:
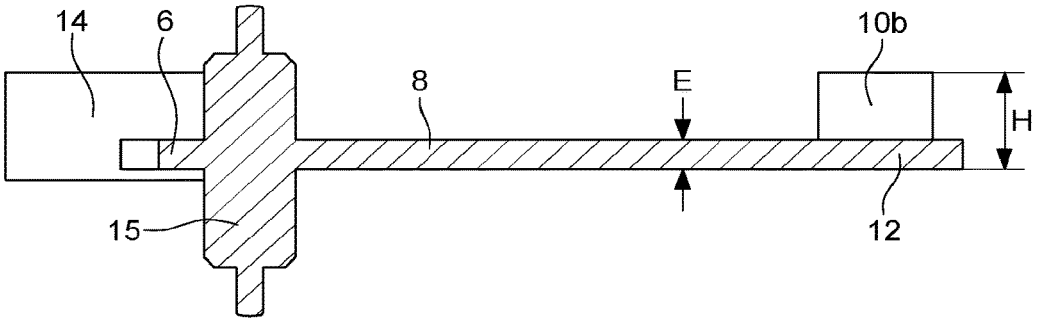
FIG. 2 is a sectional view of FIG. 1 a passing along the rod of the pallets.

The body 4 can be manufactured from various materials including silicon, silicon nitride and silicon carbide, steel, gold or one of its alloys, nickel, nickel-phosphorus, brass, copper-beryllium, nickel-silver, polymers, ceramic and amorphous metal. In the embodiment of the pallets according to FIGS. 1*a* to 1*c*, the body 4 of the pallets is manufactured by a LIGA process (lithography, galvanisation and forming) with two levels, which constitutes an economical and precise manufacturing method for small-size parts. The LIGA process for superimposing two layers of pallets with several levels is in fact described in document CH704086.

The first level, produced firstly via this method, is the additional layer of the body 4 which is composed of the portion of the first and second horns 10*a*, 10*b* which extend over the height H-E. The second level, produced secondly via this process, is the main layer of the body 4, composed of the other portion of the horns 10*a*, 10*b* of the fork 10, of the rod 8, of the safety pin 12 and of the pallet-stone support 6. Thus firstly the additional layer is formed then the main layer is formed on the additional layer in order to obtain the body 4 of the pallets 2 according to the invention.

The invention therefore makes it possible to reduce the manufacturing costs and to increase the production yields of the pallets whilst avoiding imprecisions in the positioning of the safety pin relative to the horns, in particular in the division heights of the safety pin and of the horns.

REFERENCE NUMBER LIST

Escapement
pallets 2
body 4
pallet-stone support 6
rod 8
fork 10
first horn 10*a*
bevelled surface 11*a*
second horn 10*b*
bevelled surface 11*b*
safety pin 12
pallet-stones 14
input pallet-stone
output pallet-stone
pivot 15

The invention claimed is:

1. Pallets for an escapement of a clock movement comprising:

a pallet-stone support;

pallet-stones mounted on the pallet-stone support;

a fork including first and second horns;

a safety pin; and a rod connecting the pallet-stone support to the fork and to the safety pin, wherein the pallet-stone support, the rod, the safety pin, and the fork form a monolithic body of the pallets, and wherein the pallet-stone support, the rod and the safety pin are formed by a main layer of constant thickness, and in that the first and second horns of the fork have a greater height than the constant thickness and are formed by said main layer, and also by an additional layer, the main layer and the additional layer form the monolithic body of the pallets.

2. The pallets according to claim 1, wherein the ratio between the height of the horns and the thickness of the main layer is between 1.5 and 10.

3. The pallets according to claim 1, wherein the body is manufactured from a material selected from the group of materials comprising silicon, silicon nitride, silicon carbide, steel, gold or one of its alloys, nickel, nickel-phosphorus, brass, copper-beryllium, nickel-silver, polymers, ceramic and amorphous metal.

4. The pallets according to claim 1, wherein the body is produced by a lithographic and electroforming process.

5. The pallets according to claim 4, wherein the process is a process of the LIGA type with two levels.

6. The pallets according to claim 5, wherein the additional layer is formed before the main layer.

7. An escapement of a clock movement comprising the pallets according to claim 1.

8. A clock movement comprising the escapement according to claim 7.

* * * * *